United States Patent [19]

Anderson

[11] 4,011,419

[45] Mar. 8, 1977

[54] SWITCH BLADE

[75] Inventor: Fred N. Anderson, Waukegan, Ill.

[73] Assignee: Cherry Electrical Products Corporation, Waukegan, Ill.

[22] Filed: Jan. 21, 1976

[21] Appl. No.: 650,890

[52] U.S. Cl. ..... 200/67 B; 200/164 R

[51] Int. Cl.[2] ..... H01H 13/28

[58] Field of Search ..... 200/67 R, 67 A, 67 B, 200/67 D, 164

[56] References Cited

UNITED STATES PATENTS

| | | | |
|---|---|---|---|
| 2,792,465 | 5/1957 | Libermann | 200/67 B |
| 3,400,234 | 9/1968 | Long | 200/67 B |

*Primary Examiner*—David Smith, Jr.
*Attorney, Agent, or Firm*—Edward C. Threedy

[57] ABSTRACT

A switch blade for a snap-action switch having an over-centering mechanism including a coil spring for pivotally connecting the switch blade upon a pivotal mounting, and a reciprocally movable actuator for deflecting the spring out of its normal plane with resulting tension onto a switch blade, which will cause the same to move off a stationary contact with a shearing and rocking breaking action.

8 Claims, 6 Drawing Figures

SWITCH BLADE

SUMMARY OF THE INVENTION

The switch blade of this invention comprises an improvement over the construction and function of the switch blades shown and described in U.S. Pat. No. 3,073,923, dated Jan. 15, 1963, and No. 3,382,332, dated May 7, 1968, both issued to Cherry Electrical Products Corporation, the assignee of the present application.

The switch blade is a component of a snap-action switch that includes a pivotal mounting for one end of the switch blade, with the blade pivoted by an overcentering mechanism consisting in part of a coil spring connected between a portion of the movable blade and a part of the pivotal mounting.

An actuator operable upon the spring to change its line of tension by yieldably moving the same out of a predetermined longitudinal plane, causes a portion of the blade to respond initially to such change in the spring tension by moving laterally across a stationary contact, such as in a shearing motion, and by rocking on such stationary contact, such as in a rolling motion, subsequently to complete separation therefrom. This shearing and rocking motion breaks all spark welds between the blade and the stationary contact and promotes a fast and positive electrical separation therebetween.

GENERAL DESCRIPTION

The improvement in the switch blade of this invention is shown in the accompanying drawings illustrating the preferred form of embodiment of the invention by which the stated objects thereof are achieved, and in which.

Figure 1:
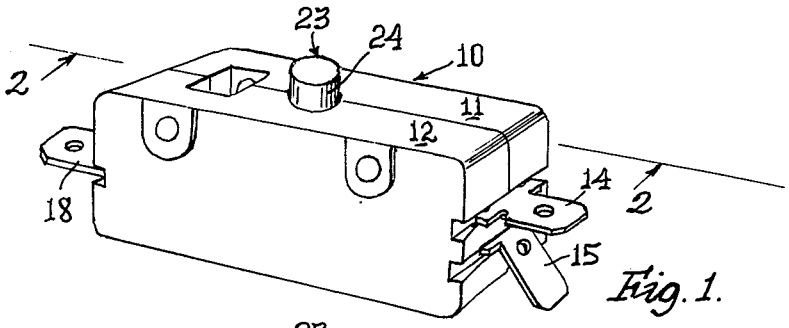
FIG. 1 is a perspective view of a snap-action switch.

Referring to FIG. 1, there is shown a switch housing 10 consisting of complementary housing sections 11 and 12 forming therebetween a cavity 13.

The switch components comprise fixed contact-bearing terminals 14 and 15, each of which provides spaced confronting contact heads 16 and 17.

A base terminal 18 provides a pair of spaced apart vertically extending fingers 19, as well as a verically extending lug 20 to which is adapted to be connected one end of a coil spring 21. The coil spring 21 will extend between the spaced fingers 19 and have its other end connected to a movable switch blade 22.

Figure 2:
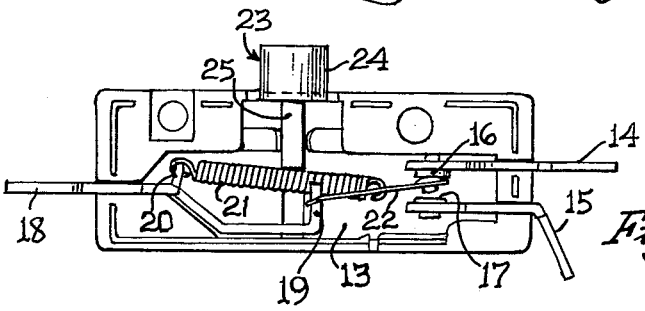
FIG. 2 is a side elevational view of the switch having a side wall removed and showing the components in an unactuated position.
Figure 3:
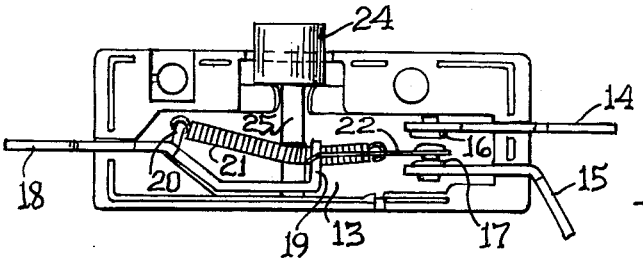
FIG. 3 is a view similar to that of FIG. 2, showing the components in an actuated position.

A switch actuator 23 comprises an exposed circular actuating button 24 which normally projects upwardly through a suitable opening in the switch housing 10, as shown in FIGS. 1, 2 and 3. The switch actuator 23 includes an elongated rectangularly shaped lug 25, the lower end of which is adapted to be seated upon the coil spring 21 to one side of the spaced apart fingers 19 and intermediate the ends of the spring 21, as shown.

Figure 4:
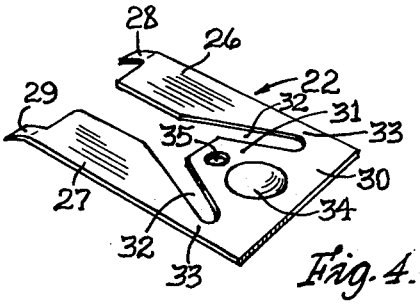
FIG. 4 is a perspective view of the improved switch blade utilized in the snap-action switch.

The specific embodiment of the present invention is found in the switch blade 22, as is seen in FIG. 4. The switch blade 22 comprises a generally U-shaped member having spaced apart legs 26 and 27. Each of the legs 26 and 27 terminates into angular tabs 28 and 29 which are adapted to be positioned outwardly of each of the longitudinal edges of the spaced apart fingers 19, as shown in FIGS. 2 and 3.

The blade 22 provides a free end body portion 30 which provides a truncated rearwardly extending tongue portion 31. The tongue portion 31 is formed by slots 32 cut from the inward longitudinal edges of each of the legs 26 and 27 and which extend in a diverging direction outwardly toward the opposite side edges of the free end body portion 30 of the blade 22. By this arrangement and at the point where the slots 32 terminate, there remains a narrow neck portion 33 extending between the reduced legs 26 and 27 and the free end body portion 30 of the blade 22.

Along a line extending between the outward ends of the slots 32 is mounted a switch contact 34 such that half of the switch contact 34 is carried by the tongue 31, while the remaining portion is on the free end 30 of the blade 22.

Figure 6:
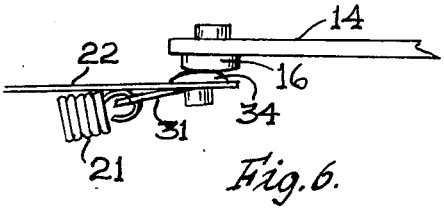
FIG. 6 is an enlarged fragmentary view of certain components of the invention in an intermediate actuated position.
Figure 5:
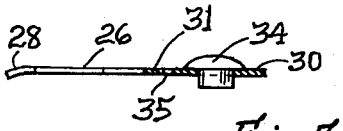
FIG. 5 is a detailed sectional view of the improved switch blade.

When the blade 22 of this invention is mounted in the switch housing 10, it will assume the position shown in FIG. 2, whereby the contact 34 of the blade 22 is in engagement with the contact 16 of the terminal 14; this by reason of the predetermined longitudinal plane of the spring 21 which, as clearly shown, extends above the longitudinal plane of the blade 22 as well as its point of pivotal connection with the fingers 19. When the actuator 23 is depressed, the spring 21 will be deformed downwardly out of its normal longitudinal plane and, in so doing, will increase the tension of the spring 21 onto the switch blade 22, increasing the compression of the legs 26 and 27 against the fingers 19. At the same time as the spring continues to be deflected downwardly, it will cause the tongue 31 to be bent downwardly out of the normal longitudinal plane of the blade 22, as shown in FIG. 6. This deflection of the spring 21 as well as the increased tension exerted thereon against the blade 22, will cause the contact head 34, half of which is carried by the tongue 31, to move laterally across the face of the contact 16 of the terminal 14, as well as to slightly rotate in a counterclockwise direction as shown in FIG. 6, so as to wipe across the face of the contact 16.

Continued movement of the spring 21 by the actuator 23 will, in effect, cause the pivoting of the free end body portion 30 of the switch blade 22 in a downward direction until it engages the contact 17 of the terminal 15, as shown in FIG. 3. The switch will remain in this position until the actuating force is removed from the actuator 23, at which time the spring 21 will return to its normal position shown in FIG. 2, and the switch blade 22 will follow in a reversing movement to that previously described.

The shearing and wiping action of the contact 34 of the switch blade 22 results from the fact that by constructing the switch blade 22 in the manner hereinafter noted, there are provided switch blade legs 26 and 27 which have a width greater than a connecting neck 33 between such legs and the free end body portion 30 of the switch blade. The outwardly diverging slots 32 which form the tongue 31 of the blade, as well as defining the narrow necks 33 between the legs 26 and 27 and the free end of the blade, permit the tongue 31 to have a substantial longitudinal deflection, by reason of the fact that the spring 21 is connected to the free end of the tongue 31 through an aperture 35 formed therein. The placement of the contact 34, so as to be half carried by the tongue 31 and the free end body portion 30 of the blade, forces shearing and rocking movement of the contact 34 relative to the fixed contacts during the actuation of the spring 21.

From the foregoing, it is apparent that I have described an improved switch blade for a snap-action switch that performs a shearing and rocking action prior to a complete separation between the contact faces, whereby spark welds are broken and the faces of the contacts are kept relatively clean.

While I have illustrated and described the preferred form of construction for carrying my invention into effect, this is capable of variation and modification without departing from the spirit of the invention. I, therefore, do not wish to be limited to the precise details of construction set forth, but desire to avail myself of such variations and modifications as come within the scope of the appended claims.

Having thus described my invention, what I claim as new and desire to protect by Letters Patent is:

1. A switch blade for a snap-action switch having a pivotal mounting for one end of the blade and an overcentering mechanism including a coil spring for yieldably holding the blade on the mounting and for pivoting the blade between stationary contacts, wherein the improvement comprises a. a substantially flat rectangularly shaped switch blade body, b. a first slot cut inwardly of one end of said body dividing said end of said body into a pair of pivotal legs, c. a tongue formed in said body by a pair of slots extending in opposite diverging directions from the inner end of said first slot, with said diverging slots terminating adjacent the opposite longitudinal edges of said body and short of the other end thereof, d. a contact carried on the line of junction between said tongue and said other end of said body and in normal engagement with one of the stationary contacts, e. said tongue providing means for connection to one end of the coil spring so as to pivotally connect said legs onto the pivotal mounting, and f. means formed by said pair of slots providing a connection between said legs and said other end of said body about which said tongue is flexed out of its normal plane by the coil spring, with said contact moving with said tongue in a shearing and rocking action off the stationary contact it normally engages.

2. A switch blade for a snap-action switch as defined by claim 1, wherein said means providing a connection between said legs and said other end of said body comprise necks of material connecting said other end of said body to said legs and which yieldably resist the flexing of said other end of said body out of its normal plane as said tongue is flexed by the spring.

3. A switch blade for a snap-action switch as defined in claim 1, wherein said means providing a connection between said tongue and the coil spring comprises an aperture formed in the free end of said tongue and lying in a centerline extending between said legs and through said contact.

4. A switch blade for a snap-action switch as defined by claim 3, wherein said means providing a connection between said legs and said other end of said body comprise necks of material connecting said other end of said body to said legs and which yieldably resist the flexing of said other end of said body out of its normal plane as said tongue is flexed by the spring.

5. A switch blade for a snap-action switch as defined by claim 1, wherein said contact comprises a semicircular head, a portion of which lies on said tongue and the remaining portion of which lies on said other end of said body.

6. A switch blade for a snap-action switch as defined by claim 5, wherein said means providing a connection between said legs and said other end of said body comprise necks of material connecting said other end of said body to said legs and which yieldably resist the flexing of said other end of said body out of its normal plane as said tongue is flexed by the spring.

7. A switch blade for a snap-action switch as defined by claim 5, wherein said means providing a connection between said tongue and the coil spring comprises an aperture formed in the free end of said tongue and lying in a center-line extending between said legs and through said contact.

8. A switch blade for a snap-action switch as defined by claim 4, wherein said contact comprises a semicircular head, a portion of which lies on said tongue and the remaining portion of which lies on said other end of said body.

* * * * *